US009502004B2

(12) United States Patent
Ohba

(10) Patent No.: US 9,502,004 B2
(45) Date of Patent: Nov. 22, 2016

(54) SUPPORT ASSEMBLY AND KEYBOARD APPARATUS

(71) Applicant: Yamaha Corporation, Hamamatsu-shi, Shizuoka-ken (JP)

(72) Inventor: Akito Ohba, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/080,355

(22) Filed: Mar. 24, 2016

(65) Prior Publication Data

US 2016/0284325 A1 Sep. 29, 2016

(30) Foreign Application Priority Data

Mar. 25, 2015 (JP) ..... 2015-063215

(51) Int. Cl.
*G10C 3/16* (2006.01)

(52) U.S. Cl.
CPC ..... *G10C 3/168* (2013.01); *G10C 3/16* (2013.01)

(58) Field of Classification Search
CPC ..... G10C 3/16
See application file for complete search history.

(56) References Cited

U.S. PATENT DOCUMENTS

| | | | | |
|---|---|---|---|---|
| 269,405 | A | 12/1882 | Gemunder | |
| 1,771,685 | A | 7/1930 | Moser | |
| 2,540,871 | A | 2/1951 | Finholm | |
| 3,240,095 | A * | 3/1966 | Steinway | G10C 3/16 384/300 |
| 5,239,907 | A * | 8/1993 | Sugiyama | G10C 3/26 84/239 |
| 6,232,537 | B1 * | 5/2001 | Kimble | G10C 3/16 84/216 |
| 6,740,801 | B2 * | 5/2004 | Yoshisue | G10C 3/22 84/423 R |
| 7,807,907 | B2 * | 10/2010 | Inoue | G10C 3/22 84/234 |
| 2009/0173206 | A1 | 7/2009 | Inoue | |

FOREIGN PATENT DOCUMENTS

| | | |
|---|---|---|
| EP | 2 079 074 A1 | 7/2009 |
| JP | 2005-292361 A | 10/2005 |
| JP | 2009-163044 A | 7/2009 |

OTHER PUBLICATIONS

European Search Report dated Aug. 30, 2016, for EP Application No. 16161154.6, ten pages.

* cited by examiner

*Primary Examiner* — Robert W Horn
(74) *Attorney, Agent, or Firm* — Morrison & Foerster LLP

(57) ABSTRACT

A support assembly including a support rotatably disposed with respect to a frame, a repetition lever hinge mounted to the support, and a repetition lever supported by the repetition lever hinge and rotatably disposed with respect to the support, wherein the repetition lever has a contact surface and the contact surface contacts a hammer shank roller provided to a hammer shank for rotating a hammer, and the repetition lever hinge is mounted to the support in a mounting direction that crosses with a tangent-line direction of a line tangent to the hammer shank roller at the contact between the hammer shank roller and the contact surface.

15 Claims, 10 Drawing Sheets

SUPPORT ASSEMBLY AND KEYBOARD APPARATUS

CROSS REFERENCE TO RELATED APPLICATIONS

This application is based upon and claims the benefit of priority from the prior Japanese Patent Application No. 2015-063215, filed on Mar. 25, 2015, the entire contents of which are incorporated herein by reference.

FIELD

Embodiments of the present invention relates to a support assembly for use in a keyboard apparatus.

BACKGROUND

Conventional acoustic pianos such as grand pianos and upright pianos are made up by many components. Since assembling these components is very complex, the assembling operation takes long time. In particular, since an action mechanism provided correspondingly to each key requires many components, its assembling operation is very complex.

For example, in an action mechanism described in Japanese Unexamined Patent Application Publication No. 2005-292361, a plurality of components act each other, and key operation by key pressing and key releasing is transmitted to a hammer. In particular, a support assembly configuring part of the action mechanism operates with various components assembled together. The support assembly has not only a mechanism which achieves string hammering by the hammer in accordance with key pressing but also an escapement mechanism for releasing a force transmitted to the hammer by key operation immediately before string hammering. This mechanism is an important mechanism for achieving basic operation of the acoustic piano. In particular, in a grand piano, a double escapement mechanism having a repetition lever and a jack combined together is generally adopted.

The operation of the action mechanism provides a sense (hereinafter referred to as a touch feeling) to a finger of a player through a key. In particular, the structure of the support assembly provides an important influence on the touch feeling. For example, the touch feeling by the operation of the escapement mechanism is called let-off.

SUMMARY

According to embodiments of the present invention, a support assembly including a support rotatably disposed with respect to a frame, a repetition lever hinge mounted to the support, and a repetition lever supported by the repetition lever hinge and rotatably disposed with respect to the support, wherein the repetition lever has a contact surface and the contact surface contacts a hammer shank roller provided to a hammer shank for rotating a hammer, and the repetition lever hinge is mounted to the support in a mounting direction that crosses with a tangent-line direction of a line tangent to the hammer shank roller at the contact between the hammer shank roller and the contact surface.

According to one embodiment of the present invention, a keyboard apparatus including a plurality of support assemblies, a keys disposed correspondingly to the respective support assembly, and a sound emission mechanism adapted to emit sound in accordance with the key pressing, wherein each of the support assemblies includes, a support rotatably disposed with respect to a frame, a repetition lever hinge mounted to the support, and a repetition lever supported by the repetition lever hinge and rotatably disposed with respect to the support, wherein the repetition lever has a contact surface and the contact surface contacts a hammer shank roller provided to a hammer shank for rotating a hammer, and the repetition lever hinge is mounted to the support in a mounting direction that crosses with a tangent-line direction of a line tangent to the hammer shank roller at the contact between the hammer shank roller and the contact surface.

According to one embodiment of the present invention, the repetition lever hinge may be tilted in a direction parallel to a direction of a force of the hammer shank roller acting on the repetition lever.

According to one embodiment of the present invention, a coupling portion of the repetition lever hinge coupled to the repetition lever may be tilted to a rotation center side of the support from one end on the support side.

According to one embodiment of the present invention, the repetition lever hinge may be tilted with respect to the direction of the tangent line of the point of contact where the hammer shank roller makes contact with the repetition lever.

According to one embodiment of the present invention, the repetition lever and the repetition lever hinge may be integrally molded.

According to one embodiment of the present invention, the repetition lever and the repetition lever hinge may include a resin-made structure.

REFERENCE SIGNS LIST

Figure 1:
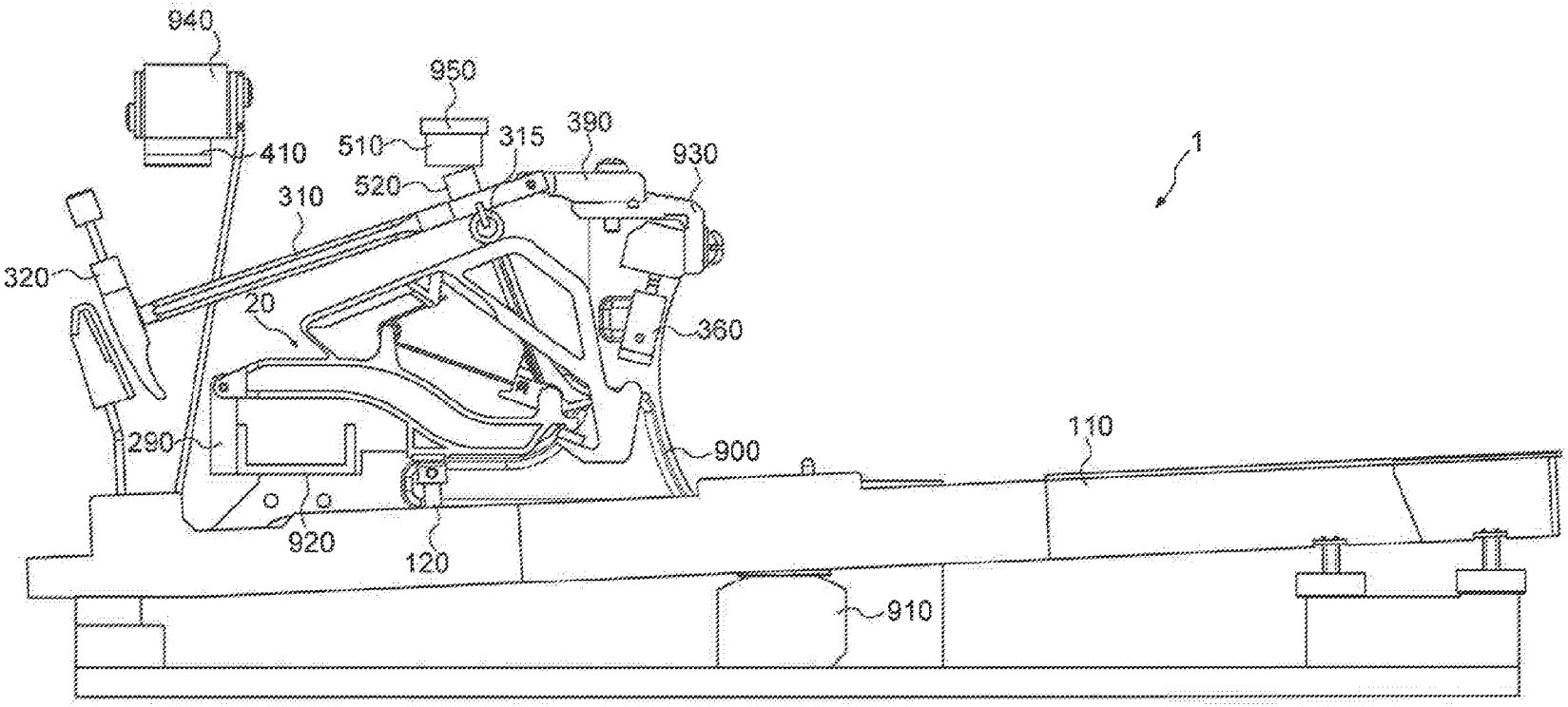
FIG. 1 is a side view depicting the structure of a keyboard apparatus in one embodiment of the present invention.

1 . . . keyboard apparatus, 2 . . . keyboard apparatus, 20 . . . support assembly, 210 . . . support, 2105 . . . jack support portion, 2109 . . . through hole, 212 . . . support heel, 216 . . . stopper, 218 . . . spring support portion, 220 . . . repetition lever hinge, 240 . . . repetition lever, 242 . . . spring contact portion, 244 . . . extension, 2441 . . . inner portion, 2442 . . . outer portion, 2443 . . . coupling portion, 2444 . . . stopper contact portion, 250 . . . jack, 2502 . . . large jack, 2504 . . . small jack, 2505 . . . support connecting portion, 2562 . . . spring contact portion, 280 . . . torsion coil spring, 2802 . . . first arm, 2804 . . . second arm, 290 . . . support flange, 310 . . . hammer shank, 315 . . . hammer shank roller, 320 . . . hammer, 346 . . . repetition regulating screw, 360 . . . regulating button, 390 . . . shank flange, 410 . . . hammer stopper, 50 . . . sound emission mechanism, 510 . . . sensor, 520 . . . shielding plate, 550 . . . signal converting unit, 560 . . . sound source unit, 570 . . . output unit, 60 . . . support assembly, 610 . . . support, 6105 . . . jack support unit, 612 . . . support heel, 620 . . . repetition lever hinge, 632 . . . fixing unit, 638 . . . base, 640 . . . repetition lever, 644 . . . extension, 6442 . . . slit, 6444 . . . slit, 650 . . . jack, 6502 . . . large jack, 6504 . . . small jack, 660 . . . operation regulating unit, 662 . . . support unit, 664 . . . stopper, 666 . . . guide, 674 . . . fixture, 682 . . . coil spring, 684 . . . coil spring, 900 . . . bracket, 910 . . . balance rail, 920 . . . support rail, 930 . . . shank rail, 940 . . . hammer stopper rail, 950 . . . sensor rail, 960 . . . support rail.

DESCRIPTION OF EMBODIMENTS

In the following, a keyboard apparatus including a support assembly in one embodiment of the present invention is described in detail with reference to the drawings. Embodiments described below are merely examples of embodiments of the present invention, and the present invention should not be interpreted to be restricted to these embodiments. Note that, in the drawings referred to in the present embodiments, identical portions or portions having a similar function are provided with a same sign or similar sign (sign with a numeral merely followed by "a", "b", or the like), and repetitive description thereof may be omitted. Also, for convenience of description, the dimensional ratios in the drawings (such as ratios between respective structures, or length ratios) may differ from actual ratios, and parts of the structure may be omitted from the drawings.

A support assembly of a keyboard apparatus has many components, and therefore the manufacturing time is prolonged, and manufacturing costs are high. Therefore, to reduce manufacturing costs, it is desirable to decrease the number of components and simplify the structure. However, if the structure of the support assembly is changed, the touch feeling at the time of key operation is greatly changed. Therefore, it is difficult to decrease the expense of manufacturing an acoustic piano.

One object of the embodiments of the present invention is to reduce manufacturing costs of a support assembly while decreasing a change in touch feeling at the time of key operation, compared with a keyboard apparatus of an acoustic piano. Also, one object of the embodiments of the present invention is to improve structural stability of the support assembly while simplifying the structure.

First Embodiment

1-1. Structure of Keyboard Apparatus 1

A keyboard apparatus 1 in one embodiment of the present invention is an example obtained by applying one example of the support assembly according to one embodiment of the present invention to an electronic piano. To obtain a touch feeling close to a grand piano at the time of key operation, this electronic piano includes a structure similar to a support assembly included in the grand piano. By using FIG. 1, a general outline of the keyboard apparatus 1 according to one embodiment of the present invention is described.

FIG. 1 is a side view depicting a mechanical structure of the keyboard apparatus according to one embodiment of the present invention. As depicted in FIG. 1, the keyboard apparatus 1 according to one embodiment of the present invention includes a plurality of keys 110 (in this example, eighty-eight keys) and an action mechanism corresponding to each of the keys 110. The action mechanism includes a support assembly 20, a hammer shank 310, a hammer 320, and a hammer stopper 410. Note that while FIG. 1 depicts the case in which the keys 110 are white keys, the keys may be black keys. Also, in the following description, terms representing orientations such as a player's forward side, a player's depth side, upward, downward, and sideward are defined as orientations when the keyboard apparatus is viewed from a player's side. For example, in the example of FIG. 1, the support assembly 20 is disposed on a player's forward side when viewed from the hammer 320, and is disposed upward when viewed from the key 110. Sideward corresponds to a direction in which the keys 110 are arranged.

The key 110 is rotatably supported by a balance rail 910. The key 110 rotates in a range from a rest position depicted in FIG. 1 to an end position. The key 110 includes a capstan screw 120. The support assembly 20 is rotatably connected to a support flange 290, and is mounted on the capstan screw 120. The support flange 290 is fixed to a support rail 920. Detailed structure of the support assembly 20 will be described further below. Note that the support flange 290 and the support rail 920 are one example of a frame serving as a reference of rotation of the support assembly 20. The frame may be formed of a plurality of members, such as the support flange 290 and the support rail 920, or may be formed of one member. The frame may be, as with the support rail 920, a rail-shaped member with a long side in the arrangement direction of the keys 110, or may be, as with the support flange 290, an independent member for each key 110.

The hammer shank 310 is rotatably connected to a shank flange 390. The hammer shank 310 includes a hammer roller 315. The hammer shank 310 is mounted on the support assembly 20 via the hammer roller 315. The shank flange 390 is fixed to a shank rail 930. The hammer 320 is fixed to an end of the hammer shank 310. A regulating button 360 is fixed to the shank rail 930. The hammer stopper 410 is fixed to a hammer stopper rail 940 to be disposed at a position of regulating rotation of the hammer shank 310.

A sensor 510 is a sensor for measuring the position and moving speed (speed immediately before the hammer shank 310 collides with the hammer stopper 410) of the hammer shank 310. The sensor 510 is fixed to a sensor rail 950. In this example, the sensor 510 is a photo interrupter. In accordance with the amount of shielding the optical axis of the photo interrupter by a shielding plate 520 fixed to the hammer shank 310, an output value from the sensor 510 is changed. Based on this output value, the position and moving speed of the hammer shank 310 can be measured. Note that a sensor for measuring an operating state of the key 110 may be provided in place of the sensor 510 or together with the sensor 510.

The above-described support rail 920, shank rail 930, hammer stopper rail 940, and sensor rail 950 are supported by a bracket 900.

1-2. Structure of Support Assembly 20

Figure 2:
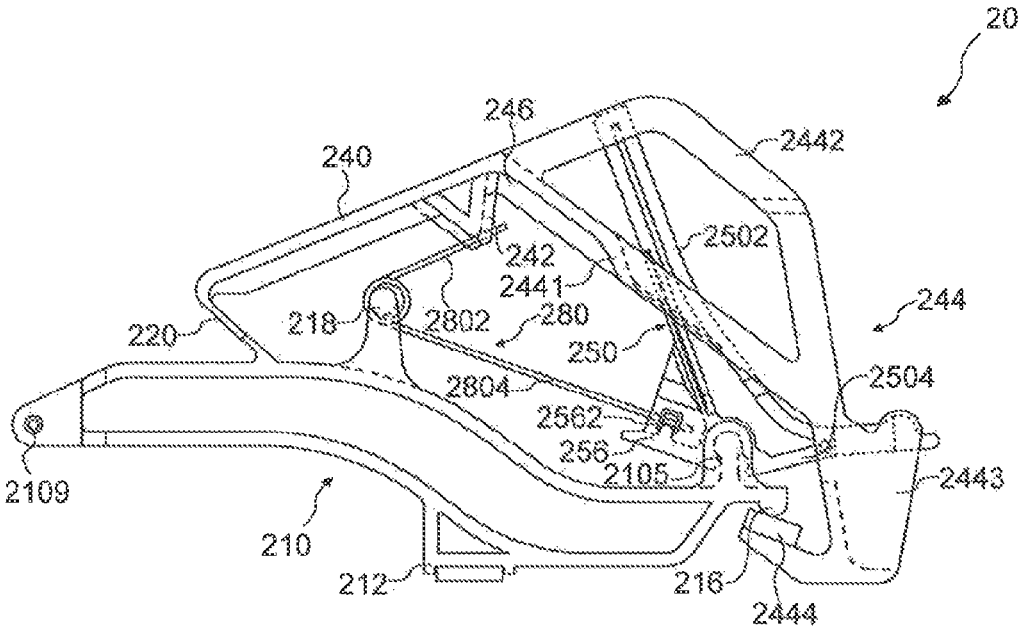
FIG. 2 is a side view depicting the structure of a support assembly in one embodiment of the present invention.
Figure 3A:
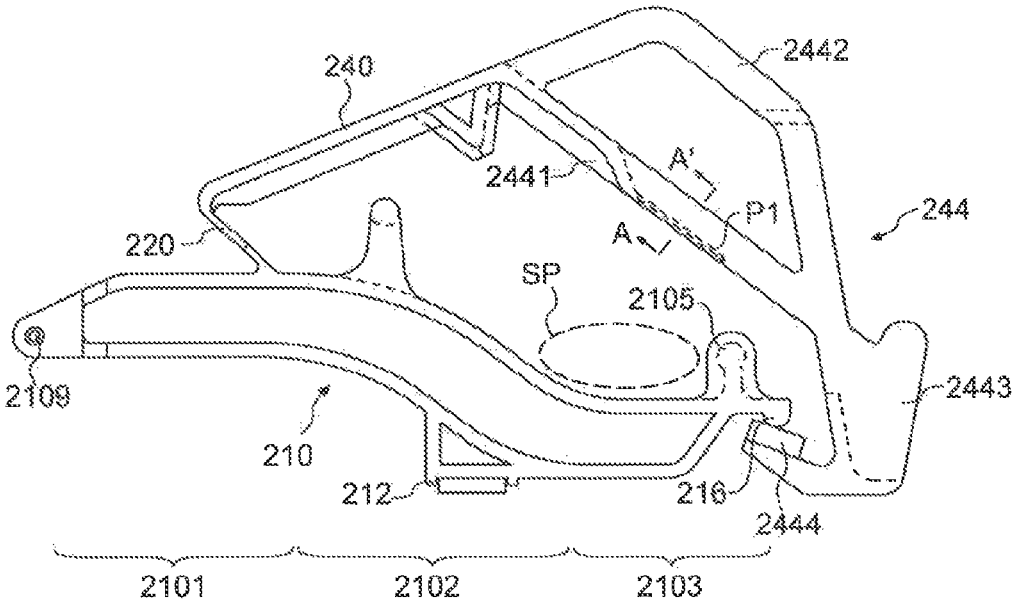
FIG. 3A is a side view depicting a partial structure of the disassembled support assembly in one embodiment of the present invention.
Figure 3B:
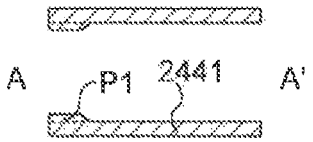
FIG. 3B is a side view depicting a partial structure of the disassembled support assembly in one embodiment of the present invention.
Figure 3C:
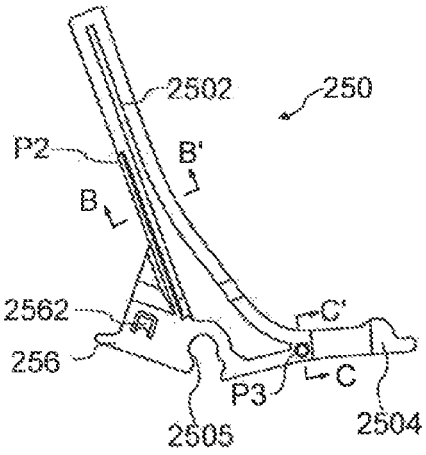
FIG. 3C is a side view depicting a partial structure of the disassembled support assembly in one embodiment of the present invention.

FIG. 2 is a side view depicting the structure of the support assembly in one embodiment of the present invention. FIG. 3A to FIG. 3G are side views each depicting a partial structure of the disassembled support assembly in one embodiment of the present invention. For easy understanding of a feature of each component, FIG. 3A is a drawing in which a jack 250 and a torsion coil spring 280 are excluded from the support assembly 20. FIG. 3C is a drawing only depicting the jack 250.

The support assembly 20 includes a support 210, a repetition lever 240, the jack 250, and the torsion coil spring 280. The support 210 and the repetition lever 240 are coupled together via a repetition lever hinge 220. In this embodiment, the hinge 220 is formed as a blade spring. In this example, the hinge 220 is formed integrally with the support 210 and the repetition lever 240, for example out of resin material. However, the invention is not limited by this example, and the hinge 220 can be of any suitable type, for example a barrel hinge or folding hinge, or any other construction that enables a limited angle of rotation around a rotation axis. In case of implementation of the hinge in the form of multiple sections rotating around a pivot, the hinge may be provided with an elastic element like a spring to bias the rotational angle of the hinge towards a starting position. The hinge 220 can be implemented in any suitable way, like being formed in one piece together with the support 210 and the repetition lever 240, or being partially or wholly a separate component connected to both the support 210 and the repetition lever 240. As far as the orientation of the hinge 220 in the initial or rest position is concerned, in the case of an embodiment in an essentially flat fashion, like a blade spring hinge or a resin film hinge, the orientation of the hinge is determined by the plane of the flat blade or film. Conversely, hinges that are formed in an essentially flat way, like a straightened out folding hinge, the orientation in the initial state is defined by a plane through the mostly flat section of the hinge. In case of a hinge that is essentially non-flat, like a curved blade or film hinge, the orientation of the hinge in initial condition is defined by a plane defined by the connection portions on respectively the support 210 and the lever 240. By the repetition lever hinge 220, the repetition lever 240 is rotatably supported with respect to the support 210. The support assembly 20, except the torsion coil spring 280 and cushioning materials (such as nonwoven fabric or elastic material) provided at a portion which collides with another member, is an injection molded structure made of resin. In this example, the support 210 and the repetition lever 240 are integrally formed. Note that the support 210 and the repetition lever 240 may be formed as individual components and be attached or bonded together.

The support 210 has one end side where a through hole 2109 is formed, and has the other end side where a jack support portion 2105 is formed. Between the through hole 2109 and the jack support portion 2105, the support 210 includes a support heel 212 projecting downward and a spring support portion 218 projecting upward. Through the hole 2109, a shaft supported by the support flange 290 is drawn. With this, the support 210 is rotatably disposed with respect to the support flange 290 and the support rail 920. The support heel 212 has its lower surface which makes contact with the above-described capstan screw 120. The sprint support portion 218 supports the torsion coil spring 280. The jack support portion 2105 rotatably supported the jack 250.

Between the through hole 2109 and the jack support portion 2105, a space SP is formed on a jack support portion 2105 side from the support heel 212. For convenience of description, the support 210 is portioned into regions: a first main body portion 2101, a bent portion 2102, and a second main body portion 2103, from a through hole 2109 side. In this case, by the bent portion 2102 which couples the first main body portion 2101 and the second main body portion 2103 together, the second main body portion 2103 is disposed on a side closer to the key 110 (downward) than the first main body portion 2101. The jack support portion 2105 projects upward from the second main body portion 2103. According to this portioning, the above-described space SP corresponds to a region interposed between the bent portion 2102 and the jack support portion 2105 above the second main body portion 2103. Also, at an end of the support 210 (an end on a second main body portion 2103 side), a stopper 216 couples.

To the repetition lever 240, a spring contact portion 242 and an extension 244 are coupled. The spring contact portion 242 makes contact with a first arm 2802 of the torsion coil spring 280. The repetition lever 240 and the extension 244 include two plate-shaped members for interposition from sides of both side surfaces of the jack 250. In this example, the extension 244 and the jack 250 slidably make contact with each other in at least part of a space interposed between these two plate-shaped members.

The extension 244 includes an inner portion 2441, an outer portion 2442, a coupling portion 2443, and a stopper contact portion 2444. The inner portion 2441 is coupled in the repetition lever 240 on a player's depth side (repetition lever hinge 220 side) of a large jack 2502. At a portion where the inner portion 2441 and the repetition lever 240 are coupled together, a rib 246 is provided. The inner portion 2441 interposes the large jack 2502 to cross to extend to a player's forward side (opposite side to the repetition lever hinge 220) of the large jack 2502. At a portion of interposing the large jack 2502, the inner portion 2441 includes a linear-shaped projecting portion P1 projecting to a large jack 2502 side (refer to an A-A' end face view of FIG. 3B).

The outer portion 2442 is coupled in the repetition lever 240 on a player's forward side (opposite side to the repetition lever hinge 220) of the jack 250 (large jack 2502). The inner portion 2441 and the outer portion 2442 are coupled together at the coupling portion 2443. The coupling portion 2443 interposes a small jack 2504. The stopper contact portion 2444 couples to the coupling portion 2443, and makes contact from below the stopper 216. According to this, a rotation range in a direction in which the repetition lever 240 and the support 210 spread is regulated.

The jack 250 includes the large jack 2502, the small jack 2504, and a projecting portion 256. The jack 250 is rotatably disposed with respect to the support 210. Between the large jack 2502 and the small jack 2504, a support connecting portion 2505 to be rotatably supported by the jack support portion 2105 is formed. The support connecting portion 2505 has a shape surrounding part of the jack support portion 2105, and regulates a rotation range of the jack 250. Also, with the shape of the support connecting portion 2505 and elastic deformation of its material, the jack 250 can fit from above the jack support portion 2105. The projecting portion 256 projecting from the large jack 2502 to a side opposite to the small jack 2504, and rotates with the jack 250. The projecting portion 256 includes, on its side surface, a spring contact portion 2562. The spring contact portion 2562 makes contact with a second arm 2804 of the torsion coil spring 280.

Figure 3D:
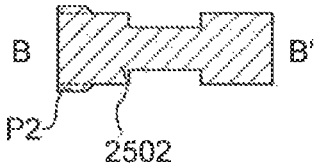
FIG. 3D is a side view depicting a partial structure of the disassembled support assembly in one embodiment of the present invention.
Figure 3E:
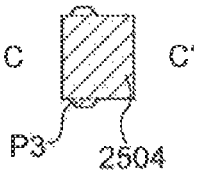
FIG. 3E is a side view depicting a partial structure of the disassembled support assembly in one embodiment of the present invention.
Figure 3F:
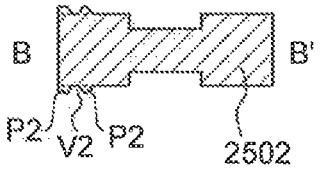
FIG. 3F is a side view depicting a partial structure of the disassembled support assembly in one embodiment of the present invention.
Figure 3G:
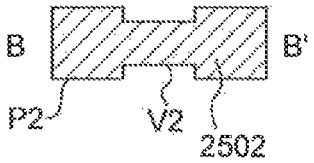
FIG. 3G is a side view depicting a partial structure of the disassembled support assembly in one embodiment of the present invention.

The large jack 2502 includes linear-shaped projecting portions P2 projecting from both side surfaces (refer to a B-B' end face view of FIG. 3D). The projecting portions P2 slidably contacts the projecting portion P1 of the inner portion 2441 described above. The small jack 2504 includes circular-shaped projecting portions P3 projecting from both side surfaces (refer to a C-C' end face view of FIG. 3E). The projecting portions P3 slidably contact an inner surface of the coupling portion 2443 described above. As such, with the jack 250 and the extension 244 slidably contacting each other via the projecting portions P1, P2, and P3, a contact area is decreased. Note that as depicted in FIG. 3F, a grease reservoir may be formed by forming a groove portion V2 by a plurality of projecting portions P2. Also, as depicted in FIG. 3G, a projecting portion P2 or groove portion V2 may be formed with a side-surface shape of the large jack 2502.

In the torsion coil spring 280, the spring support portion 218 is taken as a fulcrum, the first arm 2802 makes contact with the spring contact portion 242, and the second arm 2804 makes contact with the spring contact portion 2562. The first arm 2802 functions as an elastic body which provides a rotational force to the repetition lever 240 via the spring contact portion 242 so as to move a player's side of the repetition lever 240 upward (in a direction away from the support 210). The second arm 2804 functions as an elastic body which provides a rotational force to the jack 250 via the spring contact portion 2562 so as to move the projecting portion 256 downward (in a direction of approaching the support 210).

Figure 4:
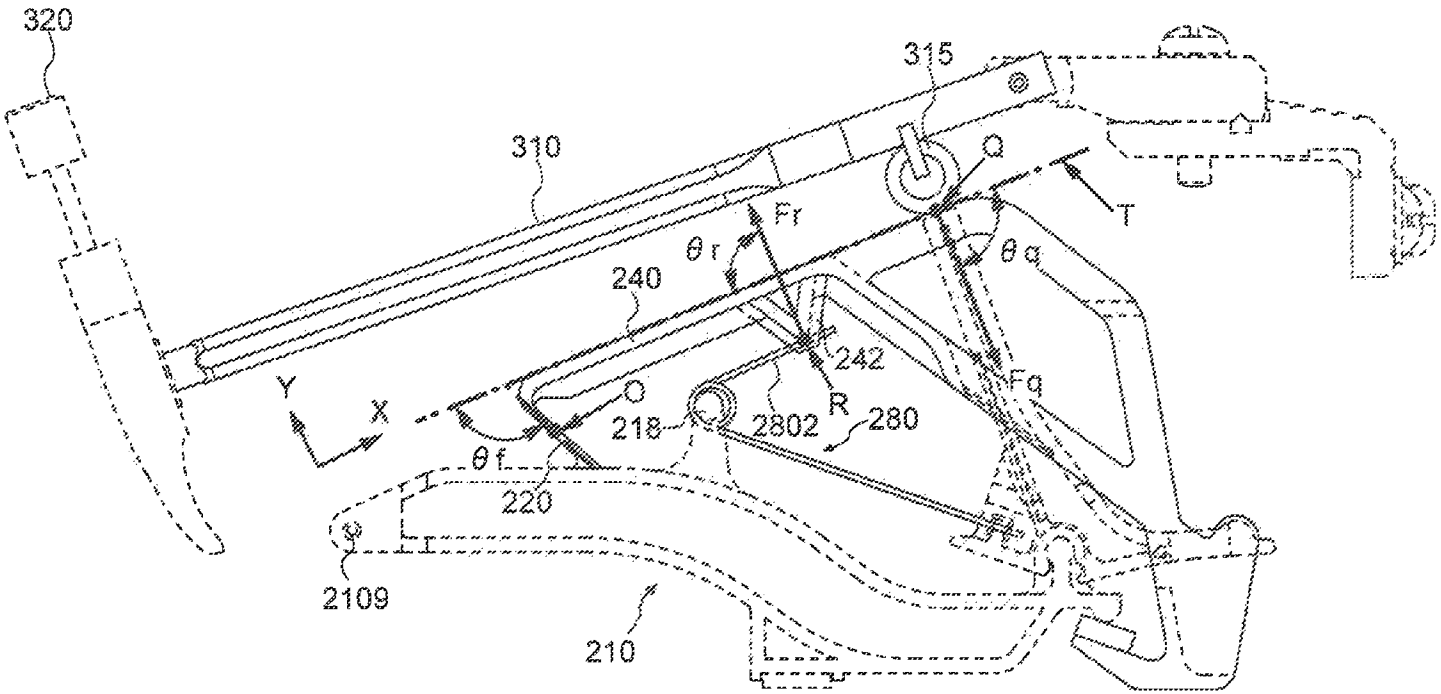
FIG. 4 is a side view describing a relation between the tilt of a repetition lever hinge and a repetition lever according to the support assembly according to one embodiment of the present invention.

FIG. 4 depicts a relation between the repetition lever 240 and the repetition lever hinge 220 in an initial or rest position; in this position the associated key is not depressed or otherwise operated. The repetition lever 240 is coupled to the repetition lever hinge 220, and the hinge 220 rotates around a rotation axis in the form of a rotation center O. Note that in this example the rotation center is located within the hinge 220 itself, but the rotation center O might lie outside the hinge for example in the case of implementation of the hinges as a curved blade spring. The repetition lever 240 abuts on the hammer shank roller 315; note that the contact surface of the lever 240 that contacts the roller 315 is essentially flat in this embodiment, and provided with an opening to let the jack 2502 through. Note that the invention is not limited to a flat contact surface; the contact surface can be implemented in any suitable geometry, for example curved, and can be provided with a surface structure like ridges, dimples and the like. The hammer shank roller 315 and the repetition lever 240 contact each other forming a line (when the materials of the roller 315 and the lever 240 are relatively inelastic) or a contact area (when the materials of the roller 315 and the lever 240 are relatively elastic). In FIG. 4 a line contact is assumed, and the side view of this line is shown as a point Q. On the repetition lever 240, loads of the hammer shank 310 and the hammer 320 are imposed via the hammer shank roller 315. FIG. 4 depicts a force received from the hammer shank roller 315 at this time as Fq. Also, the repetition lever 240 makes contact with the first arm 2802 of the torsion coil spring 280 at the spring contact portion 242. This spring contact portion 242 is taken as R. The point R is a point of action of the torsion coil spring 280, and the repetition lever 240 receives a force in a pushing-up direction by an elastic force of the torsion coil spring 280. FIG. 4 depicts this force as Fr.

In FIG. 4, a tangent line T is shown. This line T lies in a tangent plane T' that is tangent to the surface of the roller 315 and includes the line of contact between the roller 315 and the lever 240. In addition, the line T is perpendicular to the center line of the roller 315. In case of a contact between the roller 315 and the lever 240 that form a contact area, the tangent plane T' lies in the plane of the contact area. In this embodiment of the invention, the repetition lever hinge 220 is formed as an essentially flat blade spring and has an axis of rotation O' (indicated by point O in the side view of FIG. 4) that is parallel to the center axis of the roller 315. In side view, the hinge 220 is positioned under an angle θf with respect to the tangent line T. Note that this in turn means that the orientation plane of the hinge 220 and the tangent plane T' also intersect under an angle of θf. In this embodiment, the angle of θf is larger than 90 degrees. Alternatively, the angle θf can also be smaller than 90 degrees. In particular, the hinge 220 can be positioned at any angle other than 0 degree (i.e. parallel).

Therefore, the repetition lever 240 has a contact surface and the contact surface contacts the hammer shank roller to be able to rotate the hammer, and the repetition lever hinge 220 is mounted to the support in a mounting direction (defined in this embodiment by the mounting plane or orientation plane of the hinge as described before) that crosses (in this example under an angle θf that is non zero) with a tangent-line direction of a line tangent T (as described above) to the hammer shank roller at the contact between the hammer shank roller and the contact surface.

The repetition lever hinge 220 is provided as being tilted in a crossing direction with respect to a tangent line T of the point Q where the hammer shank roller 315 makes contact with the repetition lever 240. In FIG. 4, for convenience, a direction parallel to the tangent line T is taken as an X direction, and a direction orthogonal thereto is taken as a Y direction. The force (Fq) the repetition lever 240 receives from the hammer shank roller 315 acts in a direction of the normal of the tangent line T, if friction forces are ignored. That is, the force Fq acts on the repetition lever 240 at the point Q in the Y direction. Here, consider the case in which the elastic force (Fr) of the torsion coil spring 280 acts at the point R (point of action) in a direction orthogonal to the tangent line T (in the case of acting in the Y direction). In this case, Fq and Fr are only in the Y direction and, to match this, the repetition lever hinge 220 is also preferably tilted in the Y direction, that is, the direction orthogonal to the tangent line T. Note that in FIG. 4, θf is an angle formed by the tangent line T and the repetition lever hinge 220, θq is an angle formed by the tangent line T and Fq, and Or is an angle formed by the tangent line T and the force Fr.

If the repetition lever 240 where to be implemented such that the points O, R, and Q coincide with each other on a straight line (note that this implementation is not shown in the figures), the following equation holds due to the balance of rotation centering at the point O.

$$Fq \cdot OQ = Fr \cdot \sin \theta r \cdot OR \quad (1)$$

Here, when OR/OQ=r, Fq is as shown in equation (2).

$$Fq=r\cdot Fr\cdot\sin\theta r \quad (2)$$

Here, when a resultant force F of Fr and Fq is represented by being divided into Fr and Fq, $$Fx=-Fr\cdot\cos\theta r \quad (3)$$

$$Fy=Fr\cdot\sin\theta r-Fq=Fr(1-r)\sin\theta r \quad (4)$$

Therefore, a rotation angle θf of the resultant force F from an x axis is $$\theta f=\tan^{-1}(Fx/Fy)=\tan^{-1}((1-r)\sin\theta r/\cos\theta r).$$

For example, θf=approximately 74° is obtained when r=0.5 and θr=30°, and θf=approximately 131° is obtained when r=0.5 and θr=120°.

As described above, according to one embodiment of the present invention, the repetition lever hinge 220 is preferably tilted with respect to the direction of the tangent line of the point of contact where the hammer shank roller 315 makes contact with the repetition lever 240. For example, in one preferred mode, the repetition lever hinge 220 is tilted in a range of ±20 degrees in a direction parallel to a direction of a force of the hammer shank roller 315 acting on the repetition lever 240. In other words, in one preferred mode, in the repetition lever hinge 220, a portion coupled to the repetition lever 240 is tilted to a side of the rotation center O of the support 210 from one end on a support 210 side. In this case, the repetition lever hinge 220 may be tilted to a depth side of the support. With this structure, in a rest state (a state in which the key is not operated), the repetition lever hinge 220 has a force acting in a direction identical to a standing direction, and is stably held by the support 210. Also, with the force the repetition lever 240 receives from the hammer shank roller 315 and the force received from the torsion coil spring 280 acting in a direction of being cancelled out, it is possible to prevent an excessive force from acting on the repetition lever hinge 220.

The repetition lever hinge 220 may be provided as a member with flexibility and be linked to the repetition lever 240, as depicted in FIG. 2. For example, the repetition lever 240 and the repetition lever hinge 220 may be integrally molded. For example, the repetition lever and the repetition lever hinge can include a structure made of resin. With this form, the number of components of the support assembly can be reduced.

1-3. Operation of Support Assembly 20

Next, description is made to movement of the support assembly 20 when the key 110 in a state of being at the rest position (FIG. 1) is pressed down to the end position.

Figure 5:
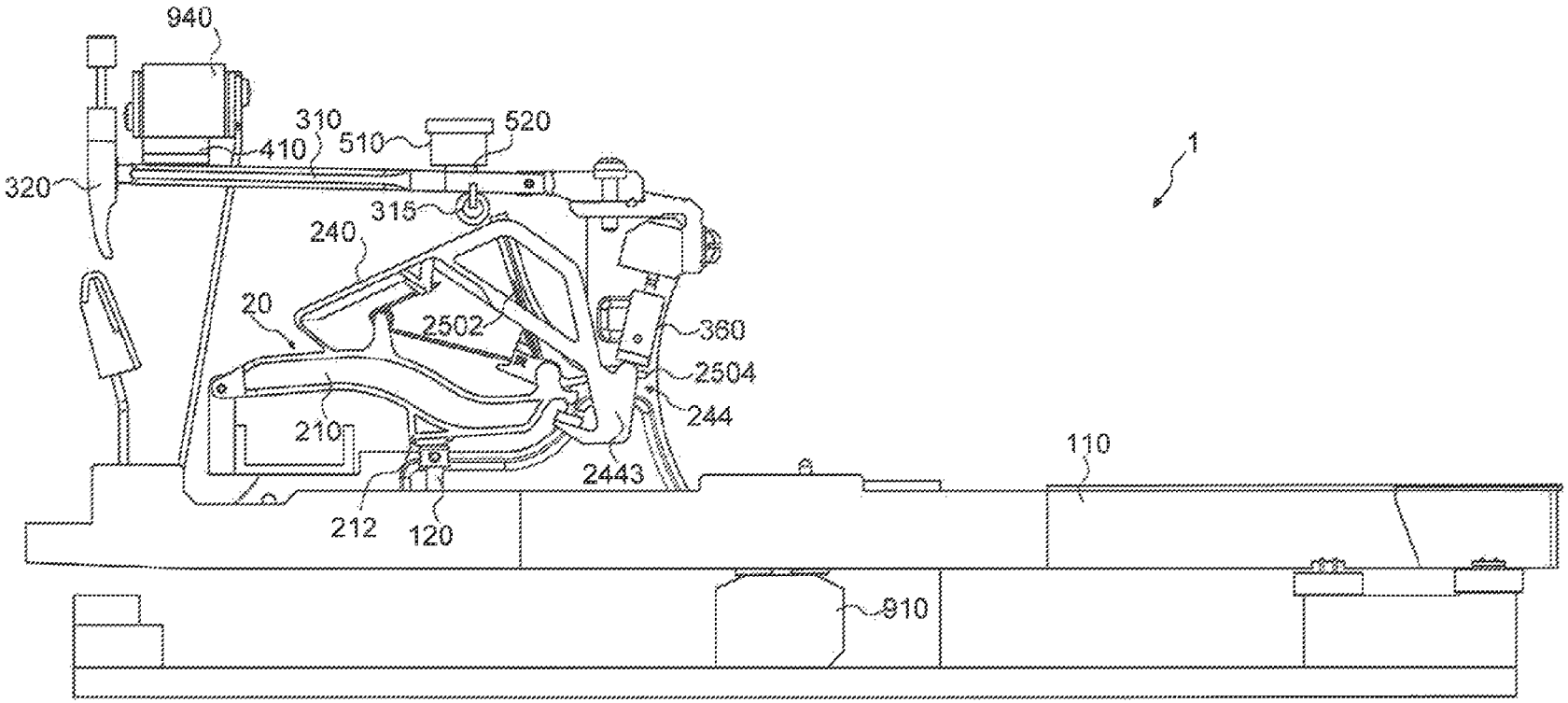
FIG. 5 is a side view depicting the structure of the support assembly according to one embodiment of the present invention.

FIG. 5 is a side view for describing movement of the support assembly in one embodiment of the present invention. When the key 110 is pressed down to the end position, the capstan screw 120 pushes up the support heel 212 to rotate the support 210, with the axis of the through hole 2109 taken as a rotation center. When the support 210 rotates to move upward, the large jack 2502 pushes up the hammer roller 315 to cause the hammer shank 310 to collide with the hammer stopper 410. Note that this collision corresponds to string hammering by a hammer in a conventional grand piano.

Immediately before this collision, while upward movement of the small jack 2504 is regulated by the regulating button 360, the support 210 (jack support portion 2105) further ascends. Therefore, the large jack 2502 rotates so as to go off from the hammer roller 315. Here, by the regulating button 360, upward movement of the coupling portion 2443 is also regulated. In this example, the regulating button 360 has also a function of a repetition regulating screw in the action mechanism in a conventional grand piano.

This regulates upward movement of the repetition lever 240, which rotates so as to approach the support 210. With these operations, a double escapement mechanism is achieved. FIG. 5 is a drawing depicting this state. Note that when the key 110 is being returned to the rest position, the hammer roller 315 is supported by the repetition lever 240, and the large jack 2502 is returned below the hammer roller 315.

As such, since double escapement is achieved in a structure simpler compared with the support assembly for use in a conventional grand piano, manufacturing cost can be slimed down while decreasing an influence on a touch feeling.

Also, since the jack 250 and the extension 244 slidably contact each other, the jack 250 functions also as a guide portion of the repetition lever 240 coupled to the extension 244. Therefore, even if yawing (lateral shift) and rolling (twisting) of the repetition lever 240 tend to occur due to the connection of the repetition lever 240 to the repetition lever hinge 220, the occurrence of these phenomena can be decreased. That is, it is possible to easily achieve rotation of the repetition lever 240 along a plane on which the jack 250 rotates.

Since the jack 250 rotates with respect to the support 210, the repetition lever 240 can also be rotated indirectly along a plane on which the support 210 rotates. In this manner, the member functioning as a guide portion (in this example, the jack 250) can be any member as long as it moves along the plane on which the support 210 rotates. Here, a structure of guiding the jack 250 may be disposed to the support 210 so that the jack 250 rotates along the plane on which the support 210 rotates. With this, it is possible to more enhance accuracy of rotating the repetition lever 240 via the jack 250 along the plane on which the support 210 rotates.

1-4. Sound Emission Mechanism of Keyboard Apparatus 1

As described above, the keyboard apparatus 1 is an example of application to an electronic piano. The operation of the key 110 is measured by the sensor 510, and a sound in accordance with the measurement result is outputted.

Figure 6:
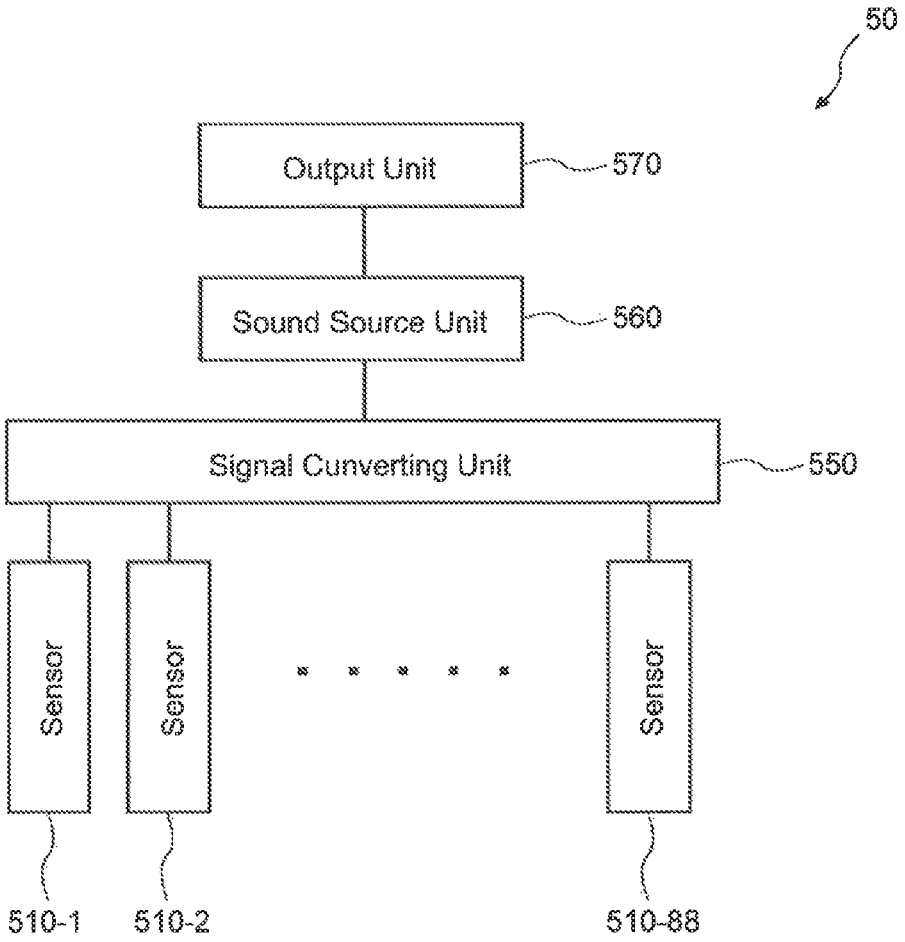
FIG. 6 is a block diagram depicting the structure of a sound emission mechanism of the keyboard apparatus according to one embodiment of the present invention.

FIG. 6 is a block diagram depicting the structure of a sound emission mechanism of the keyboard apparatus according to one embodiment of the present invention. A sound emission mechanism 50 of the keyboard apparatus 1 includes the sensors 510 (sensors 510-1, 510-2, . . . 510-88 corresponding to the eighty-eight keys 110), a signal converting unit 550, a sound source unit 560, and an output unit 570. The signal converting unit 550 obtains an electric signal outputted from the sensor 510, and generates and outputs an operation signal in accordance with an operating state in each key 110. In this example, the operation signal is a MIDI-format signal. Therefore, in accordance with the timing when the hammer shank 310 collides with the hammer stopper 410 by key-pressing operation, the signal converting unit 550 outputs Note ON. Here, a key number indicating which of the eighty-eight keys 110 has been operated and velocity corresponding to a speed immediately before the collision are also outputted in association with Note ON. On the other hand, when key-releasing operation is performed, in accordance with the timing when string vibrations are stopped by a dumper in the case of a grand piano, the signal converting unit 550 outputs the key number and Note OFF in association with each other. To the signal converting unit 550, a signal corresponding to another operation such as one on a pedal may be inputted and reflected to the operation signal. The sound source unit 560 generates a sound signal based on the operation signal outputted from the signal converting unit 550. The output unit 570 is a loudspeaker or terminal which outputs the sound signal generated by the sound source unit 560.

Second Embodiment

2-1. Structure of Keyboard Apparatus 2

A keyboard apparatus 2 in a second embodiment of the present invention is an example in which, as with the keyboard apparatus 1 of one embodiment, an example of the support assembly according to second embodiment of the present invention is applied to an electronic piano. Different points between the keyboard apparatus 2 in the second embodiment and the keyboard apparatus 1 in one embodiment are the structure of the support assembly and a portion which supports the support assembly. Also, while the regulating button 360 has a function of a repetition regulating screw in one embodiment, a repetition regulating screw is separately disposed in the second embodiment. In the following description, description is made mainly on these different points, and description of common portions is omitted.

Figure 7:
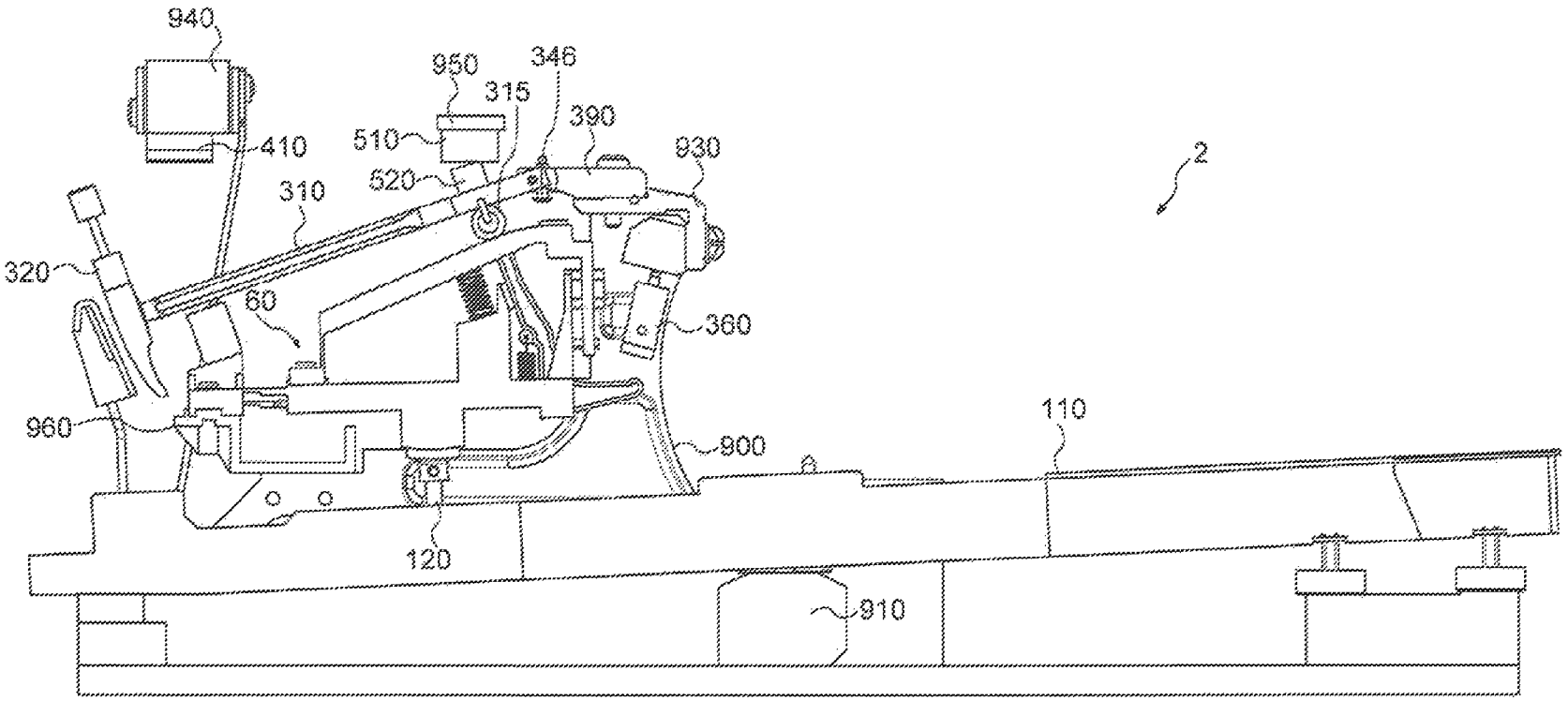
FIG. 7 is a side view depicting the structure of a keyboard apparatus according to one embodiment of the present invention.

FIG. 7 is a side view depicting the structure of the keyboard apparatus in the second embodiment of the present invention. A support assembly 60 is fixed to a support rail 960. The support rail 960 is supported by a bracket 900. The support assembly 20 according to the first embodiment is rotatably supported with the shaft supported by the support flange 290 penetrating through the through hole 2109. On the other hand, while the support assembly 60 is similar in being rotatably supported by the support rail 960, but its support method is different as will be described further below. A repetition regulating screw 346 regulates upward (hammer shank 310 side) rotation of the support assembly 60.

2-2. Structure of Support Assembly 60

Figure 8:
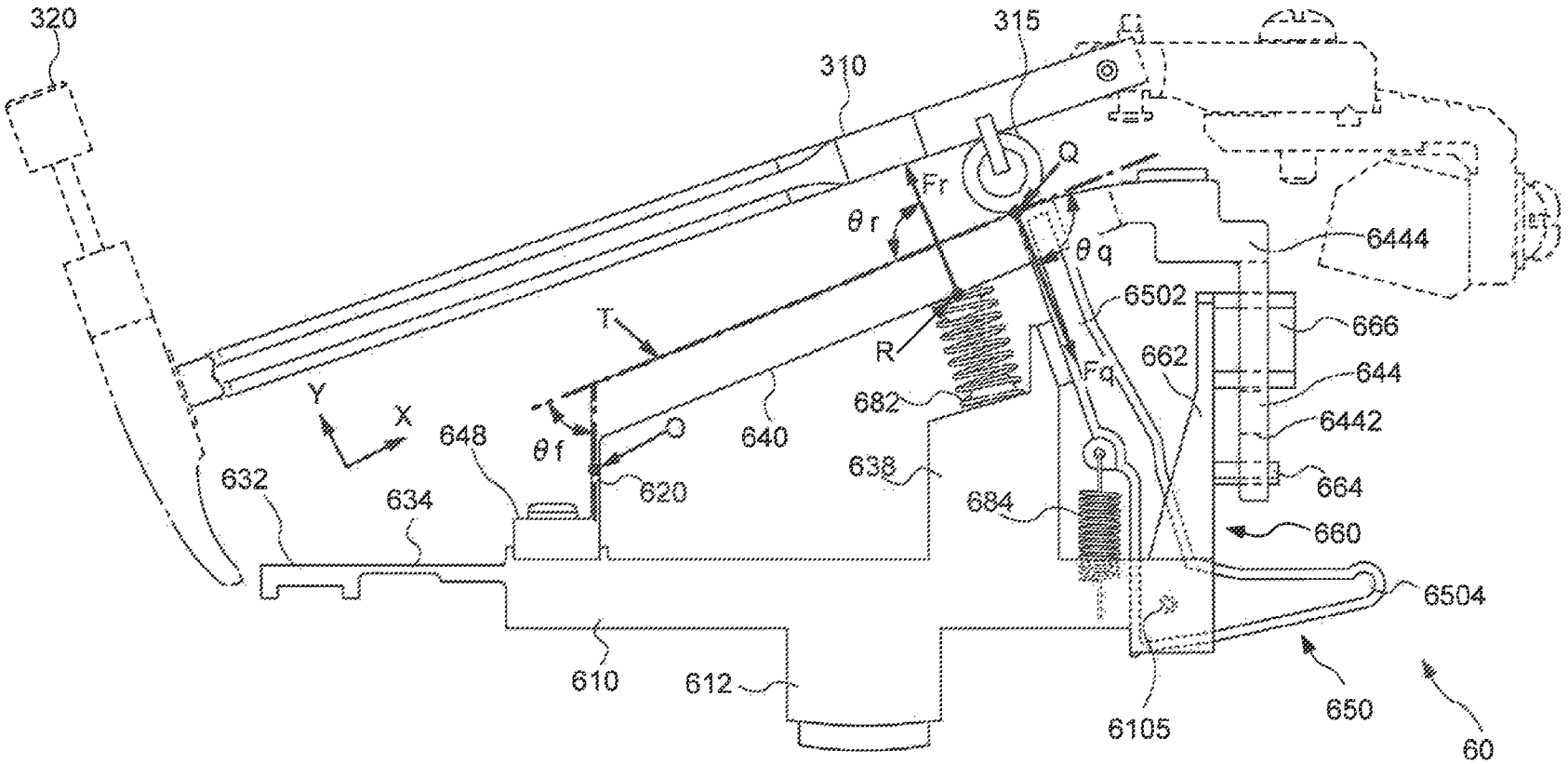
FIG. 8 is a side view depicting the structure of the support assembly according to one embodiment of the present invention.

FIG. 8 is a side view depicting the structure of the support assembly according to the second embodiment of the present invention. The support assembly 60 includes a support 610, a repetition lever 640, a jack 650, an operation regulating portion 660, and coil springs 682 and 684. The repetition lever 640 is rotatably connected to the support 610 via a repetition lever hinge 620. In this example, the support 610 and the repetition lever hinge 620 are fixed by a fixture 674 via a fixing portion 648 coupled to the repetition lever hinge 620. The support assembly 60, except the coil springs 682 and 684, cushioning materials or the like (such as nonwoven fabric or elastic body) provided at a portion which collides with another member, and fixtures is a resin-made structure manufactured by injection molding or the like.

The support 610 is fixed to the support rail 960 by a fixing portion 632. Here, with the presence of the repetition lever hinge 620 between the support 610 and the fixing portion 632, the support 610 is rotatably supported with respect to the support rail 960. The support 610 has a jack support portion 6105 formed thereto. The support 610 includes, between a repetition lever hinge 634 and a jack support portion 6105, a support heel 612 projecting downward and a base 638 projecting upward. The repetition lever hinge 620 can be implemented in a similar way and in all variants as described for the repetition lever hinge 220. In particular, the hinge 620 has similarly to hinge 220 a mounting direction or orientation under which the hinge 620 has been connected to the support.

The base 638 is connected to a repetition lever 640 side of the support 610. The coil spring 682 is disposed between the base 638 and the repetition lever 640. The coil spring 682 is a compression spring which provides a rotational force to the repetition lever 640 in a direction in which the base 638 and the repetition lever 640 go away from each other.

The repetition lever 640 has an extension 644 connected on a side opposite to the repetition lever hinge 620 with respect to a large jack 6502. The extension 644 has slits 6442 and 6444.

The jack 650 includes the large jack 6502 and a small jack 6504. The jack 650 is rotatably connected with respect to the support 610 at the jack support portion 6105. A coil spring 684 is disposed between the large jack 6502 and the support 610. The coil spring 684 is a tension spring which provides a rotational force to the jack 650 so that the large jack 6502 approaches the base 638. With the large jack 6502 making contact with the base 638, the rotation range of the jack 650 by the coil spring 680 is regulated.

The operation regulating portion 660 is coupled above (repetition lever 640 sides) from a jack support portion 6105 side of the support 610. The operation regulating portion 660 includes a support portion 662 projecting upward from the support 610, a stopper 664, and a guide 666. The stopper portion 664 and the guide portion 666 project from the support portion 662 to a player's front side. The stopper 664 penetrates through the slit 6442 provided to the extension 644. The guide 666 penetrates through the slit 6444 provided to the extension 644.

In FIG. 8, a tangent line T is shown. This line T lies in a tangent plane T' that is tangent to the surface of the roller 315 and includes the line of contact between the roller 315 and the lever 640. In addition, the line T is perpendicular to the center line of the roller 315. In case of a contact between the roller 315 and the lever 640 that form a contact area, the tangent plane T' lies in the plane of the contact area. In this embodiment of the invention, the repetition lever hinge 620 is formed as an essentially flat blade spring and has an axis of rotation O' (indicated by point O in the side view of FIG. 8) that is parallel to the center axis of the roller 315. In side view, the hinge 620 is positioned under an angle θf with respect to the tangent line T. Note that this in turn means that the orientation plane of the hinge 620 and the tangent plane T' also intersect under an angle of θf. In this embodiment, the angle of θf is larger than 90 degrees. Alternatively, the angle θf can also be smaller than 90 degrees. In particular, the hinge 620 can be positioned at any angle other than 0 degree (i.e. parallel).

Also in the present embodiment, as with the first embodiment, the repetition lever hinge 620 is tilted in a crossing direction with respect to the tangent line T at a point of contact area P where the hammer shank roller 315 makes contact with the repetition lever 640. Also in the support assembly 60, a rotation center O of the repetition lever 640, the point of contact P where the hammer shank roller 315 makes contact with the repetition lever 640, and a point of action R of the coil spring 682 with respect to the repetition lever 640 are assumed, a relation similar to that described in the first embodiment with reference to FIG. 4 can be derived.

That is, also in the support assembly 60 according to the second embodiment, with the repetition lever hinge 620 provided in a crossing direction with respect to the tangent line of the point P where the repetition lever hinge 620 makes contact with the hammer shank roller 315, it is possible to prevent an excessive force from acting on the repetition lever hinge 620.

2-3. Operation of Support Assembly 60

Description is made to movement of the support assembly 60 when the key 110 in a state of being at the rest position (FIG. 7) is pressed down to the end position.

Figure 9:
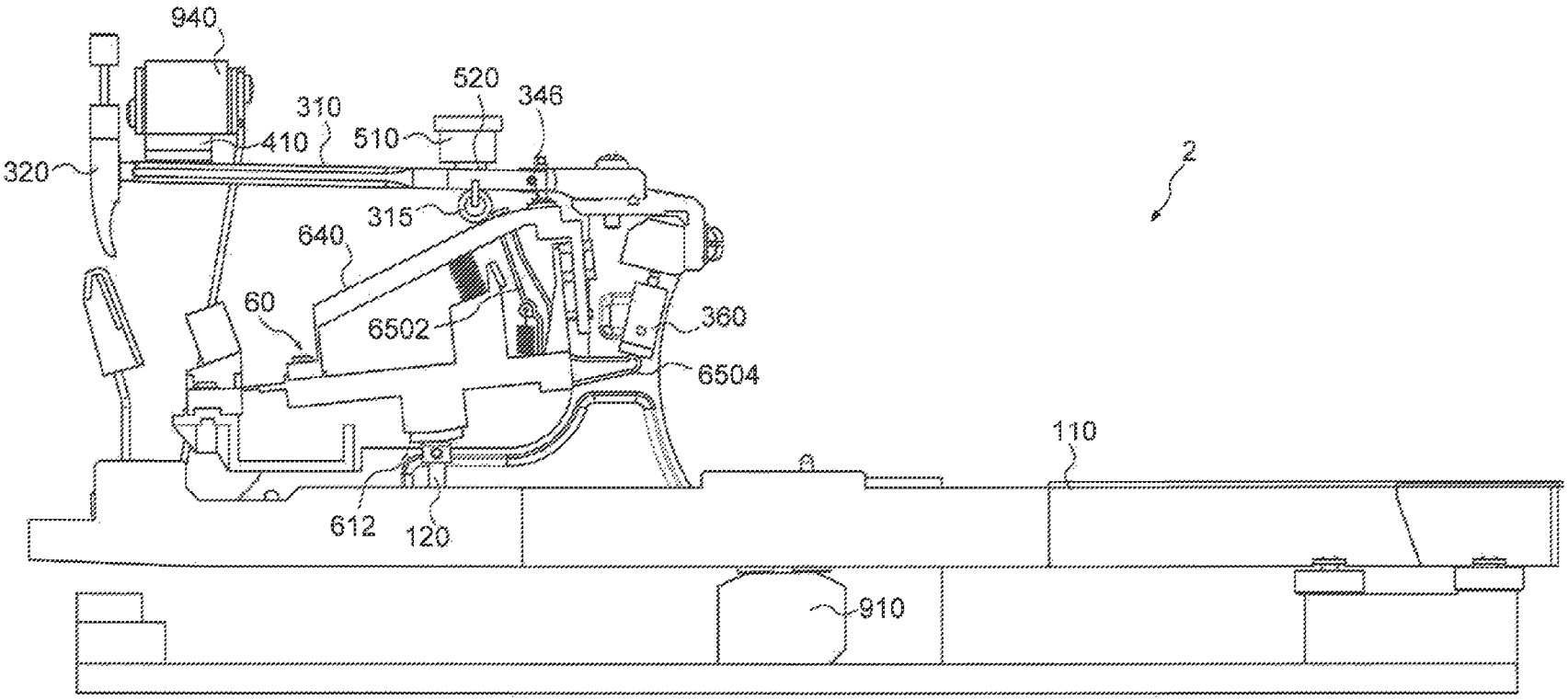
FIG. 9 is a side view depicting the structure of the support assembly in one embodiment of the present invention.

FIG. 9 is a side view for describing movement of the support assembly in one embodiment of the present invention. When the key 110 is pressed down to the end position, the capstan screw 120 pushes up the support heel 612 to rotate the support 610. When the support 610 rotates to move upward, the large jack 6502 pushes up the hammer shank roller 315 to cause the hammer shank 310 to collide with the hammer stopper 410.

Immediately before this collision, while upward movement of the small jack 6504 is regulated by the regulating button 360, the support 610 (jack support portion 6105) further ascends. Therefore, the large jack 2502 rotates so as to go off from the hammer shank roller 315. Here, by the repetition regulating screw 346, upward movement of the repetition lever 640 is also regulated.

With this, upward movement is regulated, causing the repetition lever 640 to rotate so as to approach the support 610. With these operations, a double escapement mechanism is achieved. FIG. 9 depicts this state. Note that as the key 110 is returned to the rest position, the hammer shank roller 315 is supported by the repetition lever 640, and the large jack 6502 is returned below the hammer shank roller 315.

Also with this support assembly 60, effects similar to those of the support assembly 20 can be obtained. That is, since double escapement is achieved in a structure simpler compared with the support assembly for use in a conventional grand piano, manufacturing cost can be slimed down while decreasing an influence on a touch feeling.

Also, since the guide 666 and the extension 644 slidably contact each other, the guide 666 functions also as a guide portion of the repetition lever 640 coupled to the extension 644. Therefore, even if yawing (lateral shift) and rolling (twisting) of the repetition lever 640 tend to occur due to the connection of the repetition lever 640 to the repetition lever hinge 620, the occurrence of these phenomena can be decreased. That is, it is possible to easily achieve rotation of the repetition lever 640 along a plane on which the support 610 rotates.

As described in the first embodiment and the second embodiment, according to one embodiment of the present invention, it is possible to reduce manufacturing cost of a support assembly while decreasing a change in touch feeling at the time of key operation, compared with a keyboard apparatus of an acoustic piano. Also, it is possible to improve structural stability of the support assembly while simplifying the structure of the support assembly.

In the above-described embodiment, an electronic piano is described as an example of a keyboard apparatus to which a support assembly is applied. However, one embodiment of the present invention is not restricted to this, and the support assembly disclosed in the above embodiments can also be applied to a grand piano (acoustic piano) and a keyboard apparatus with an action mechanism similar to this.

The invention claimed is:

1. A support assembly comprising:

a support rotatably disposed with respect to a frame;

a repetition lever hinge mounted to the support configured to hinge bendably from a straight line to a curve line; and a repetition lever supported by the repetition lever hinge and rotatably disposed with respect to the support, wherein the repetition lever has a contact surface and the contact surface contacts a hammer shank roller provided to a hammer shank for rotating a hammer, and the repetition lever hinge is mounted to the support in a mounting direction that crosses with a tangent-line direction of a line tangent to the hammer shank roller at the contact between the hammer shank roller and the contact surface.

2. The support assembly according to claim 1, wherein the mounting direction of the repetition lever hinge is defined by a plane and the tangent-line direction is defined by a plane.

3. The support assembly according to claim 1, wherein the repetition lever hinge is oriented in a direction parallel to a direction of a force of the hammer shank roller acting on the repetition lever.

4. The support assembly according to claim 1, wherein a coupling portion of the repetition lever hinge coupled to the repetition lever is tilted to a rotation center side of the support from one end on the support side.

5. The support assembly according to claim 1, wherein the repetition lever hinge is tilted with respect to the direction of the tangent line of the line of contact where the hammer shank roller makes contact with the repetition lever.

6. The support assembly according to claim 1, wherein the repetition lever and the repetition lever hinge are integrally formed.

7. The support assembly according to claim 1, wherein the repetition lever and the repetition lever hinge includes a resin-made structure.

8. A keyboard apparatus comprising:

a plurality of support assemblies;

a keys disposed correspondingly to the respective support assembly; and a sound emission mechanism adapted to emit sound in accordance with the key pressing;

wherein each of the support assemblies includes;

a support rotatably disposed with respect to a frame;

a repetition lever hinge mounted to the support configured to hinge bendably from a straight line to a curve line; and a repetition lever supported by the repetition lever hinge and rotatably disposed with respect to the support, wherein the repetition lever has a contact surface and the contact surface contacts a hammer shank roller provided to a hammer shank for rotating a hammer, and the repetition lever hinge is mounted to the support in a mounting direction that crosses with a tangent-line direction of a line tangent to the hammer shank roller at the contact between the hammer shank roller and the contact surface.

9. The keyboard apparatus according to claim 8, wherein the sound emission mechanism includes a sound source unit adapted to generate a sound signal in accordance with the key pressing.

10. The keyboard apparatus according to claim 8, wherein the sound emission mechanism includes a string generating a sound by striking a hammer in accordance with the key pressing.

11. The keyboard apparatus according to claim 8, wherein the repetition lever hinge is oriented in a direction parallel to a direction of a force of the hammer shank roller acting on the repetition lever.

12. The keyboard apparatus according to claim 8, wherein a coupling portion of the repetition lever hinge coupled to the repetition lever is oriented to a rotation center side of the support from one end on the support side.

13. The keyboard apparatus according to claim 8, wherein the repetition lever hinge is tilted with respect to the direction of the tangent line of the point of contact where the hammer shank roller makes contact with the repetition lever.

14. The keyboard apparatus according to claim 8, wherein the repetition lever and the repetition lever hinge are integrally formed.

15. The keyboard apparatus according to claim 8, wherein the repetition lever and the repetition lever hinge include a resin-made structure.

* * * * *